US007557678B2

(12) United States Patent
Hohenester et al.

(10) Patent No.: US 7,557,678 B2
(45) Date of Patent: Jul. 7, 2009

(54) BASE BODY FOR A YIG FILTER OR YIG OSCILLATOR

(75) Inventors: Wilhelm Hohenester, München (DE); Claus Tremmel, Haar (DE)

(73) Assignee: Rohde & Schwarz GmbH & Co. KG, München (DE)

( * ) Notice: Subject to any disclaimer, the term of this patent is extended or adjusted under 35 U.S.C. 154(b) by 40 days.

(21) Appl. No.: 11/667,925

(22) PCT Filed: Nov. 15, 2005

(86) PCT No.: PCT/EP2005/012263

§ 371 (c)(1),
(2), (4) Date: Sep. 27, 2007

(87) PCT Pub. No.: WO2006/056343

PCT Pub. Date: Jun. 1, 2006

(65) Prior Publication Data

US 2008/0117002 A1 May 22, 2008

(30) Foreign Application Priority Data

Nov. 22, 2004 (DE) ..... 10 2004 056 257

(51) Int. Cl.
*H01P 1/218* (2006.01)
*H01P 1/20* (2006.01)

(52) U.S. Cl. ..... 333/202; 333/219; 333/212

(58) Field of Classification Search ..... 333/202, 333/219, 212
See application file for complete search history.

(56) References Cited

U.S. PATENT DOCUMENTS

| | | | |
|---|---|---|---|
| 3,821,668 | A | 6/1974 | Cohen |
| 4,334,201 | A | 6/1982 | Shores |
| 4,480,238 | A | 10/1984 | Iwasaki |
| 4,857,871 | A | 8/1989 | Harris |
| 5,294,899 | A | 3/1994 | Tanbakuchi |

FOREIGN PATENT DOCUMENTS

| | | |
|---|---|---|
| DE | 43 09 852 C2 | 3/1996 |
| FR | 2 616 972 | 12/1988 |

OTHER PUBLICATIONS

International Search Report for counterpart international application PCT/EP2005/012263; Date of Mailing Oct. 2, 2006.
Written Opinion of the International Searching Authority for counterpart international application PCT/EP2005/012263 (English & German).

*Primary Examiner*—Stephen E Jones
(74) *Attorney, Agent, or Firm*—Marshall, Gerstein & Borun LLP

(57) ABSTRACT

A base element for a YIG band-pass filter or a YIG oscillator is formed from a non-magnetic material and comprises filter chambers, which are formed in the base element, wherein the filter chambers are connected to one another by channels, and YIG elements are disposed in the filter chambers and electromagnetically coupled by coupling loops disposed in the filter chambers. Slots into which contact lugs connected to the coupling loops extend, are formed in the base element. Recesses intersect the slots and and are used to accommodate a solder mass. The contact lugs are fixed in the recesses by the solder mass.

10 Claims, 1 Drawing Sheet

BASE BODY FOR A YIG FILTER OR YIG OSCILLATOR

BACKGROUND OF THE INVENTION

1. Field of the Invention

The invention relates to a base element for a YIG band-pass filter or YIG oscillator.

2. Related Technology

YIG band-pass filters or YIG oscillators contain at least one YIG element, which is preferably spherical in shape and manufactured from an yttrium-iron-garnet (YIG). The resonator effect is mediated by means of coupling loops, which must be formed and arranged in such a manner that the center point of the YIG element and the center point of the bend radius of coupling loop coincide exactly.

A YIG band-pass filter with correspondingly-formed coupling loops is known, for example, from U.S. Pat. No. 4,480,238. In this context, the adjustable YIG band-pass filter provides a base element, which comprises slots for the accommodation of insulated laminas with a conductive coating on one edge, which is used as a coupling conductor. Furthermore, filter chambers are provided to accommodate the YIG elements. The laminas are fitted over the YIG elements into the slots in such a manner that the YIG elements are arranged in indentations in the edges provided with conductive coating. The YIG elements and the laminas are attached in fixed positions.

The particular disadvantage of YIG band-pass filters with wire loops as coupling elements, as known from practical experience, is that the manufacture of the YIG filter by manual bending of the coupling loops is expensive, complicated and associated with a high reject rate.

SUMMARY OF THE INVENTION

The invention therefore provides a base element for a YIG filter or a YIG oscillator, which allows the use of prefabricated coupling loops with a reproducible, high accuracy of assembly.

Accordingly, the invention provides a base element for YIG filters or YIG oscillators, wherein the base element comprises a non-magnetic material, filter chambers formed in the base element and connected to one another by channels, YIG elements disposed in the filter chambers and electromagnetically coupled by coupling loops extending into the filter chambers, and recesses formed in the base element, into which contact lugs connected to the coupling loops extend.

BRIEF DESCRIPTION OF THE DRAWINGS

Preferred exemplary embodiments of the invention are presented below with reference to the drawings and described in greater detail in the following paragraphs. The drawings are as follows.

DETAILED DESCRIPTION

Figure 1:
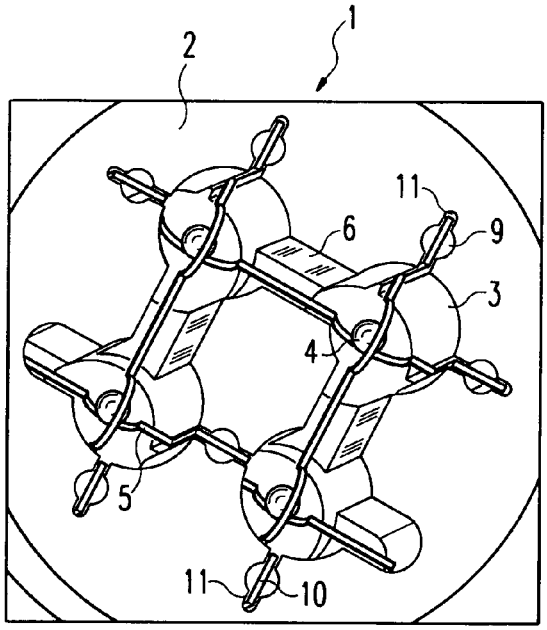
FIG. 1 shows as schematic, perspective view of a preferred exemplary embodiment of a base element for a YIG band-pass filter with YIG elements and coupling loops.
Figure 2:
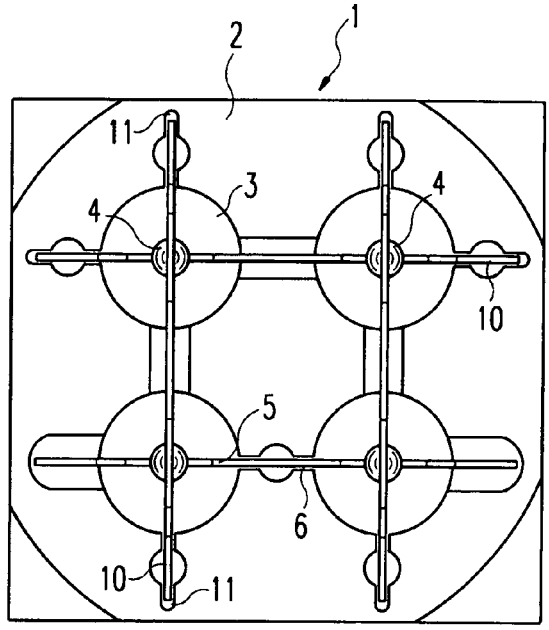
FIG. 2 shows a schematic plan view of the exemplary embodiment according to the invention of a base element for a YIG band-pass filter with YIG elements and coupling loops as presented in FIG. 1, and FIGS. 3A-B show a schematic plan view, respectively from below and from above, of the exemplary embodiment according to the invention of a base element for a YIG band-pass filter without YIG elements and coupling loops.

FIGS. 1 and 2 show, respectively in schematic perspective view and schematic plan view, an exemplary embodiment of a YIG band-pass filter 1, which provides a base element 2 and, in this exemplary embodiment, four filter chambers 3 formed in the base element 2 with an equal number of YIG elements 4.

In this example, the YIG elements 4 are spherical in shape, formed from an yttrium-iron-garnet and coupled electromagnetically by coupling loops 5.

The filter chambers 3 are connected to one another by channels 6, into which the coupling loops 5 are inserted. In this context, the channels provide sufficient distance relative to the respective coupling loops, to form conductor systems with the latter. The number of filter chambers 3 is not restricted to four, but may also be less or more.

Figure 3A:
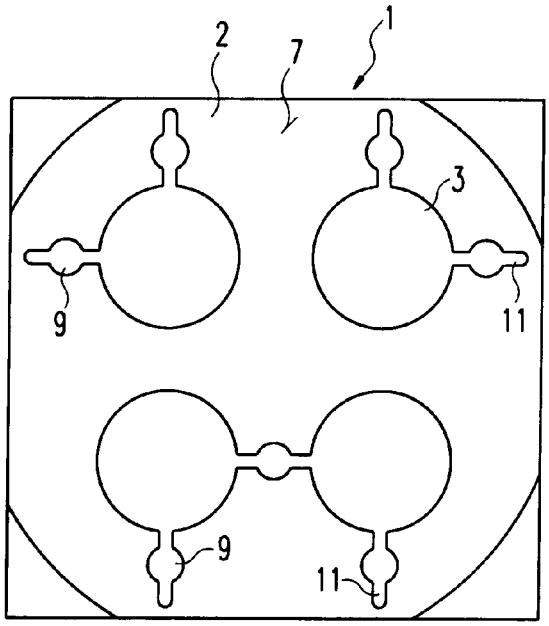
Figure 3B:
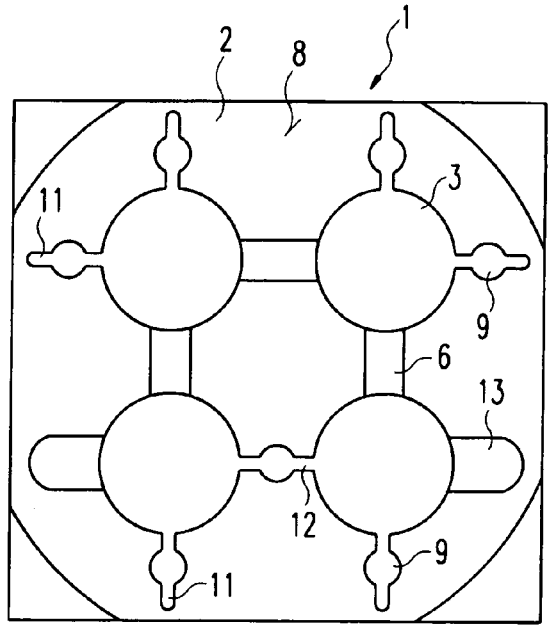

As can be seen in particular from FIG. 1, the channels 6 do not extend in their full length through the entire axial extension of the base element 2. Between the filter chambers 3, the channels 6 are formed only to a certain depth, which is somewhat more than the insertion depth of the coupling conductors 5. FIGS. 3A and 3B illustrate this with two views of the base element 2 in opposite viewing directions. FIG. 3A shows the underside 7 of the base element 2; while FIG. 3B shows the upper side 8. Accordingly, in FIG. 3A, the channels 6 between the filter chambers 3 are not visible, because they do not extend through the entire axial thickness of the base element 2; they are visible at the upper surface 8 as shown in FIG. 3B.

By contrast, beyond the filter chambers 3, slots 11 with blind ends extending radially outwards are formed through the entire axial thickness of the base element. A slot 12 is also provided between the resonators at the input and output of the filter.

Recesses 9 are also formed radially outside the filter chambers 3 and intersecting the slots 11 and 13; by contrast with the channels 6 running between the filter chambers 3, the recesses 9 extend through the entire axial thickness of the base element 2. In this context, the recesses 9 fulfil the object, on the one hand, of accommodating the coupling loops 5 and, on the other hand, of allowing the insertion of the solder mass during the assembly of the coupling loops 5.

To allow a simple assembly of the coupling loops 5, these are first manufactured from a foil with consistent accuracy and reproducibility by means of an appropriate method such as etching, laser cutting or spark erosion. To facilitate assembly, these coupling loops 5 provide contact lugs 10, which are preferably formed in one piece with the coupling loops 5 and are preferably rectangular in shape, wherein an edge length of the contact lugs 10 approximately corresponds to the axial thickness of the base element 2.

This facilitates the assembly of the coupling loops 5, because, after insertion into the slots 11 and 13, these fit so far into the slots 11 and 13, until the contact lugs 10 come into contact with the assembly work surface, on which the base element 2 is disposed during the assembly process. The contact lugs 10 then terminate flush with the lower side 7 and the upper side 8 of the base element 2. This ensures that the coupling loops 5 can always be assembled with great accuracy in the same position, and that the required degree of electromagnetic coupling can be achieved.

The solder mass introduced into the recesses 9 encloses the contact lugs 10 in such a manner that, on the one hand, the coupling loops 5 are reliably fixed in the recesses 9 and, on the other hand, a conductive connection is provided between the base element 2 and the coupling loops 5. In this context, the solder mass also flows down to the assembly work surface and therefore also terminates, above and below, flush with the upper side 8 and the lower side 7 of the base element 2, thereby providing a smooth component after assembly, which can be further processed without risk of snagging or losing the coupling loops 5.

The invention is not restricted to the exemplary embodiment presented and is suitable for YIG filters 2 or YIG oscillators of any design. The individual features of the invention can be combined with one another in any manner required.

The invention claimed is:

1. Base element for YIG filters or YIG oscillators, wherein the base element comprises a non-magnetic material, filter chambers formed in the base element and connected to one another by channels, YIG elements disposed in the filter chambers and electromagnetically coupled by coupling loops extending into the filter chambers, and recesses formed in the base element, into which contact lugs connected to the coupling loops extend, wherein the recesses extend through the entire axial thickness of the base element.

2. Base element according to claim 1, wherein the channels between the filter chambers are not formed down to a maximum insertion depth of the coupling loops in the axial direction in the base element, thereby leaving sufficient distance between the channels and the respective coupling loops, in order to form conductor systems.

3. Base element for YIG filters or YIG oscillators, wherein the base element comprises a non-magnetic material, filter chambers formed in the base element and connected to one another by channels, YIG elements disposed in the filter chambers and electromagnetically coupled by coupling loops extending into the filter chambers, recesses formed in the base element, into which contact lugs connected to the coupling loops extend, and, slots with blind ends extending radially beyond the filter chambers toward the outside, and an input resonator and an output resonator connected to one another via a slot.

4. Base element according to claim 3, wherein the slots with blind ends and the slot between the input resonator and the output resonator extend through the entire axial thickness of the base element.

5. Base element according to claim 3, wherein the recesses provide a round, rounded, or oblong-shaped cross-section.

6. Base element according to claim 3, wherein the recesses are disposed radially outside the filter chambers and between the input resonator and the output resonator.

7. Base element according to claim 3, wherein the recesses and the slots are formed in an intersecting manner.

8. Base element for YIG filters or YIG oscillators, wherein the base element comprises a non-magnetic material, filter chambers formed in the base element and connected to one another by channels, YIG elements disposed in the filter chambers and electromagnetically coupled by coupling loops extending into the filter chambers, and recesses formed in the base element, into which contact lugs connected to the coupling loops extend, wherein the recesses are suitable for the accommodation of a solder mass and contact lugs are fixed in the recesses by the solder mass.

9. Base element according to claim 8, wherein the contact lugs formed on the coupling loops terminate flush with an upper side and a lower side of the base element.

10. Base element according to claim 8, wherein the contact lugs are formed in a rectangular shape.

* * * * *